US010208600B2

(12) United States Patent
Jeute

(10) Patent No.: US 10,208,600 B2
(45) Date of Patent: Feb. 19, 2019

(54) RADIAL TURBINE

(71) Applicant: Piotr Jeute, Warsaw (PL)

(72) Inventor: Piotr Jeute, Warsaw (PL)

( * ) Notice: Subject to any disclaimer, the term of this patent is extended or adjusted under 35 U.S.C. 154(b) by 771 days.

(21) Appl. No.: 14/772,399

(22) PCT Filed: Aug. 29, 2013

(86) PCT No.: PCT/EP2013/067897
§ 371 (c)(1),
(2) Date: Sep. 3, 2015

(87) PCT Pub. No.: WO2014/135231
PCT Pub. Date: Sep. 12, 2014

(65) Prior Publication Data

US 2016/0003047 A1 Jan. 7, 2016

(30) Foreign Application Priority Data

Mar. 4, 2013 (EP) ..... 13461508

(51) Int. Cl.
*F01D 1/36* (2006.01)
*F01D 5/14* (2006.01)

(52) U.S. Cl.
CPC ..... *F01D 1/36* (2013.01); *F01D 5/147* (2013.01); *F05D 2200/33* (2013.01); *F05D 2210/43* (2013.01)

(58) Field of Classification Search
CPC ..... F01D 1/36; F01D 5/147; F05D 2200/33; F05D 2210/43
USPC ..... 416/176; 415/1
See application file for complete search history.

(56) References Cited

U.S. PATENT DOCUMENTS

2011/0164958 A1* 7/2011 Saitoh ..... F01D 1/026 415/1

* cited by examiner

*Primary Examiner* — Mark A Laurenzi
*Assistant Examiner* — Paul W Thiede
(74) *Attorney, Agent, or Firm* — Mark M. Friedman

(57) ABSTRACT

A radial turbine includes a housing, a rotor mounted on a shaft, an inlet channel for supplying a defined working medium, and an outlet channel. The rotor includes working cavities, with a generally spiral shape, which conduct the defined working medium from the inlet channel to the outlet channel, located near the center of the rotor. The working cavities have a generally rectangular cross-section, with a width (W), parallel to an axis of rotation of the rotor, and a height (H), parallel to a radius of the rotor. The width (W) is greater than the height (H), and the height (H) is not greater than six times a thickness of a boundary layer of the defined working medium.

12 Claims, 5 Drawing Sheets

RADIAL TURBINE

TECHNICAL FIELD

The present invention relates to a radial turbine, in particular to a radial steam turbine with discs having cavities for guiding the working medium.

BACKGROUND ART

A radial turbine is a turbine in which the flow of the working fluid is radial to the shaft. The flow is smoothly orientated at 90 degrees by a compressor towards the plane of working blades as well as towards the axis of the turbine shaft. As a result, in radial turbines there is less mechanical complexity and thermal stress as compared to axial turbines, which enables a radial turbine to be simpler, more robust and more cost effective especially for low power applications.

A PCT application WO2009109020 discloses a radial turbine, comprising discs with cavities, mounted alongside discs with smooth surfaces, to form channels for the working fluid and receive the kinetic impact on the surface substantially perpendicular to the direction of the working fluid, which results in the rotation of the whole rotor.

A U.S. Pat. No. 6,973,792 discloses an engine comprising multiple discs mounted coaxially next to each other, in one embodiment the discs being covered with a catalyst layer. Each catalyst layer is etched such that at least one channel is formed between the discs. This allows, among others, for production of hydrogen, as well as to use the energy of the incoming medium for rotating the output shaft.

There is also known a bladeless turbine, invented by Nicola Tesla, which is a radial turbine using a boundary layer effect, occurring between smooth, uninterrupted surfaces of thin discs arranged closely next to each other and mounted coaxially on said shaft, provided with the working medium tangentially to their circumference. The turbine has several advantages, one of them being an ability to self-start while using only the energy of incoming medium. The other advantages are a relatively high expansion ratio and a high efficiency in applications when working under small loads.

A U.S. Pat. No. 1,061,206 discloses a radial bladeless turbine of the above-discussed type, comprising a number of discs aligned close to each other and provided, through a nozzle, with the working medium, e.g. steam, tangentially to the circumference of the rotor discs and perpendicular to its shaft. The discs have openings located in their center parts, providing the exit for the working medium. This bladeless construction results in a comparatively low torque. Not only is the maximum achievable torque relatively low, but it requires high rotational speed. On top of that the original Tesla turbine requires discs produced and assembled with high precision, so as to prevent the irregularities in the space created between them, which irregularities may be causing turbulences in the flow of the working medium, and what eventually may decrease its overall efficiency.

A US application US2011/0164958 discloses a radial turbine utilizing several forces resulting from a pressurized working medium provided through a nozzle substantially tangentially to the rotors circumference. One of these forces is a frictional (viscous) force. The turbine comprises a plurality of discs, mounted in a short distance to each other, with spacer discs placed between them. The shape of the discs results in formation of spiral channels after assembly. The turbine is configured to be operated with fluids of extremely low kinematic viscosity.

A PCT application WO2009/088955 discloses a radial turbine utilizing a frictional (viscous) force. It comprises a plurality of discs, mounted close to each other. One of the features discussed in WO2009/088955 concerns the distance between the discs, dependent on the thickness of the boundary layer of the fluid used to propel the turbine. This indicates that to improve the turbine efficiency, the discs shall be spaced close to each other.

DISCLOSURE OF THE INVENTION

The aim of the present invention is to provide a radial turbine featuring an efficient operation, while maintaining relatively simple construction, allowing low production cost and high reliability. The aim is to provide a radial turbine useful in common Rankine cycle, applicable mainly to small heat generating boilers.

The object of the present invention is a radial turbine comprising: a housing; a rotor mounted within the housing on a shaft; an inlet channel for supplying a defined working medium generally tangentially in respect to the circumference of the rotor; an outlet channel located near the centre of the rotor; the rotor comprising working cavities of a generally spiral shape starting generally tangentially to the circumference of the rotor, for conducting the defined working medium from the inlet channel to the outlet channel. The working cavities of the rotor are of generally rectangular cross-section, which has a width (W), oriented generally parallel to the axis of rotation of the rotor, longer than the height (H) of said rectangular cross-section, oriented generally parallel to the radius of the rotor, wherein the height (H) of the cavity cross-section is not greater than six times the thickness of a boundary layer of the defined working medium developed on the internal surface of the wider wall of the cavity under normal working conditions of the turbine.

Preferably, the working medium is steam.

Preferably, the rotor is formed by at least two discs (6*a*, 6*b*) inserted oppositely to each other.

Preferably, cavities in disc constitute spaces allowing for insertion of the opposite disc (6*b*) with cavities, so that they form working cavities of spiral shape, through which the working fluid passes on its way from inlet channel to outlet channel, such that the fluid travels around the shaft at least 180 degrees before it reaches the outlet channel.

Preferably, the working cavities have an end portion for directing the outflowing working medium opposite to the direction of the rotor rotation.

Preferably, the working cavities have a height from 0.4 mm to 4 mm, preferably from 0.5 mm to 1.5 mm.

Preferably, the cavities have in a cross-section the width (W) which is at least 10, preferably at least 20, times larger than the height (H).

Preferably, the rotor has a conical portion for mounting on the shaft, for directing the outflowing working medium to the outlet channel.

Preferably, the height (H) of the cavities is equal to four times the thickness of a boundary layer of the working medium developed on the internal surface of the wider wall of the cavity.

Preferably, the height (H) of the cavities is equal to two times the thickness of a boundary layer of the working medium developed on the internal surface of the wider wall of the cavity.

Preferably, the spiral shape of working cavities resembles a golden spiral.

Preferably, the rotor is mounted on a hollow shaft comprising holes, wherein holes are connected to the ends of the working cavities, so that the hollow shaft constitutes the outlet channel.

The radial turbine according to the present invention benefits from the effects of adhesion and viscosity, expansion and cooling of the working medium, as well as from kinetic energy of the supplied working medium imparted to the working surface of the turbine. It is particularly useful for application in Combined Heat and Power (CHP) solutions, wherein the energy is released by burning a biomass or other fuel. Such released energy is then converted into electricity and heat, in a manner thoroughly described in the literature, and used later for the needs of a household. The working medium is preferably a steam, used commonly in CHP. The turbine uses the boundary layer effect. The boundary layer is a layer of a fluid moving next to a surface, in which the effects of viscosity are of the greatest significance, which further allows for transmitting the energy of incoming working medium to the shaft. The thickness of the boundary layer depends on many factors, among others on the type of the working medium and its parameters and according to it range from micrometers to millimeters, further depending on working conditions and construction parameters. The cross-section dimensions of the slit/cavity are designed in order to utilize the viscosity/adhesion and friction phenomena at the top and bottom part of the slit. Therefore, the substantial part of the torque and force is generated at the slot surfaces parallel to the axis of rotation, unlike in case of the Tesla turbine which utilizes the viscosity of medium to perpendicular surfaces of the rotor.

The discs which constitute a two-part rotor can be easily manufactured with a high precision, allowing to obtain a rotor with a cavity in form of a narrow slit having precise dimensions.

BRIEF DESCRIPTION OF DRAWINGS

The present invention is shown by means of exemplary embodiments on a drawing, in which.

MODES FOR CARRYING OUT THE INVENTION

Figure 1:
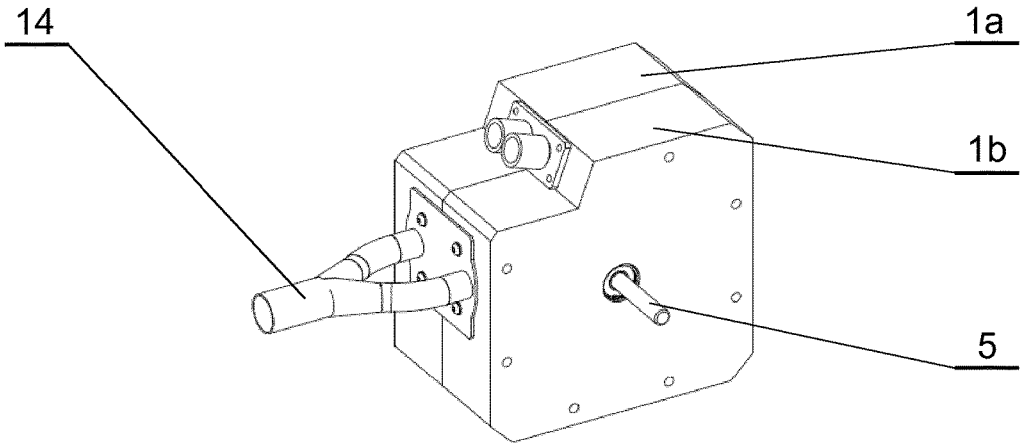
FIG. 1 shows a radial turbine assembly.

FIG. 1 shows a radial turbine assembly in isometric view.

Figure 2:
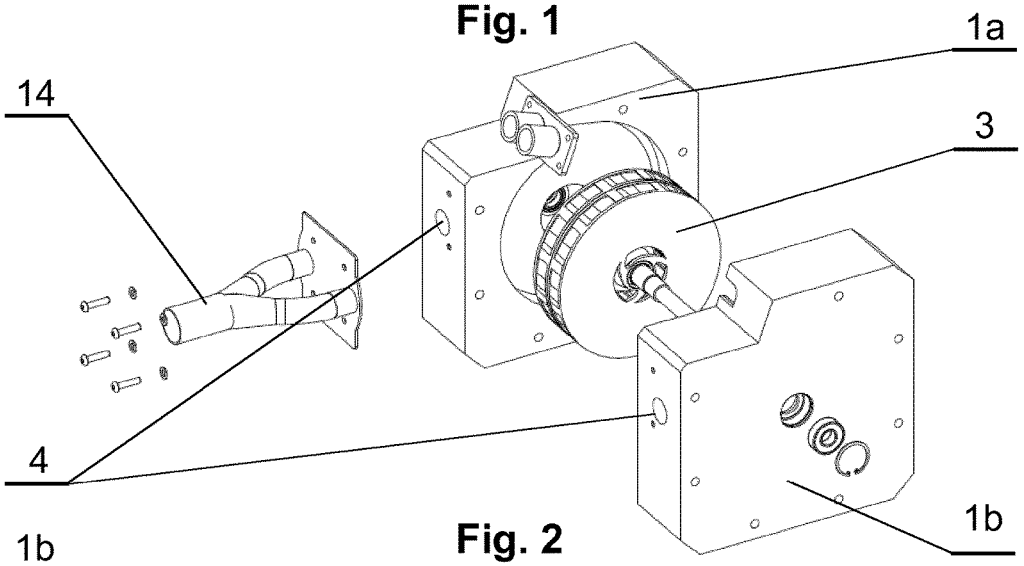
FIG. 2 is an exploded view of the radial turbine assembly of FIG. 1.

As shown in FIG. 2, the turbine comprises two halves of a housing 1, which joined together constitute working space for the rotor 3. The working medium enters the turbine through the inlet channel 2 and leaves the turbine through the exhaust chamber 13 and the outlet channel 4. In this particular embodiment, each half of the housing 1 has its own outlet channel 4, as shown on the FIG. 2, and these outlet channels 4 are connected externally with a manifold 14.

Figure 3:
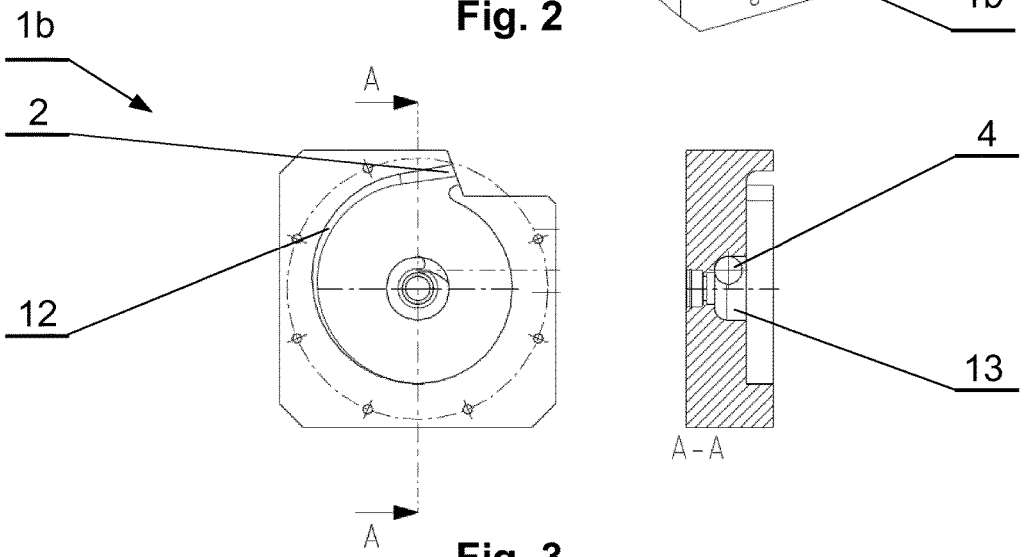
FIG. 3 shows a housing part.

FIG. 3 shows housing part 1*b*, constituting with the other housing part la the housing 1 of the turbine. The housing part 1*b* is substantially a mirror image of part 1*a*, as presented in the FIG. 2. The housing part 1*b* comprises the inlet channel 2, which directs the incoming working medium substantially tangentially to the circumference of the rotor 3 disc. The flow of the working medium after its entrance through the inlet channel 2 is constrained within the housing by spiral extrusion, named here as directing channel 12. It favours gradual entering of the working medium into the cavities around substantially half of the rotors 3 perimeter. The outlet channel 4, situated in this embodiment perpendicular to the rotation axis of the rotor 3 relatively close to the shaft 5, allows for the exit of the working medium. The working medium, after travelling through the working cavities, enters the half spherical chamber 13, and then exits through the outlet channel 4. The spaces between the sides of the rotor 3 and the housing parts 1*a* and 1*b* comprise adequate sealing, preventing the working fluid from bypassing the working cavities 9 of the rotor 3 on its way from inlet channel 2 to outlet channel 4.

Figure 4:
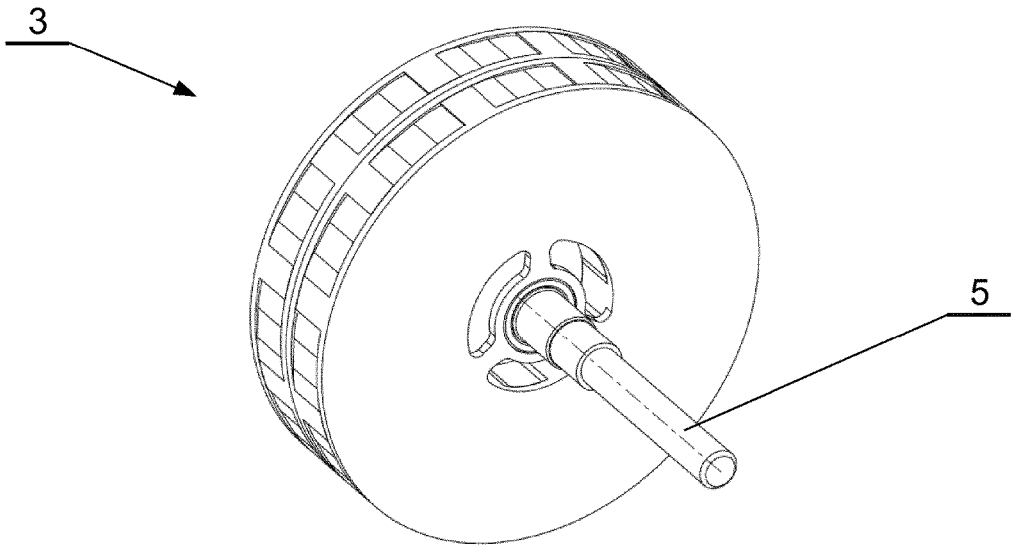
FIG. 4 shows a rotor discs mounted on the shaft

FIG. 4 illustrates the rotor assembly, presenting two coaxial disc pairs joined together and mounted on the shaft 5.

Figure 5:
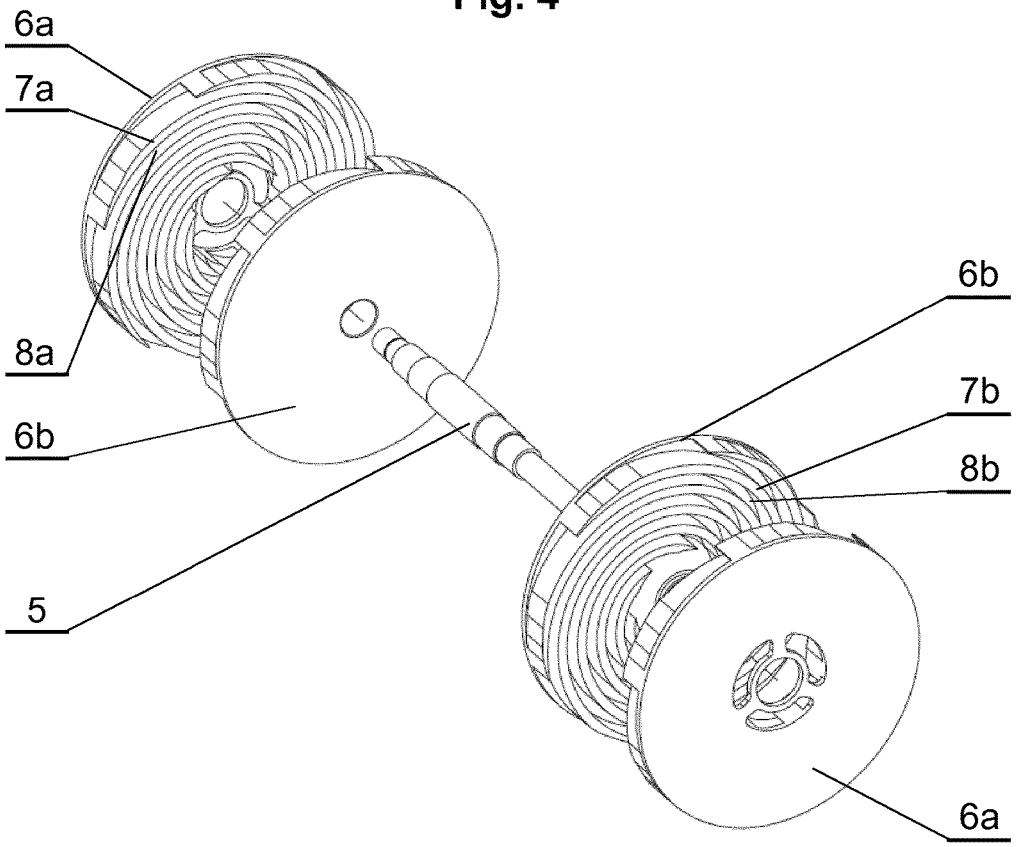
FIG. 5 is an exploded view of the rotor of FIG. 4.

FIG. 5 shows the rotor assembly in an exploded view. The rotor comprises, in this particular embodiment, two pairs of discs, each pair having disc 6*a* and disc 6*b*. Discs 6*a* have cavities 8*a* with walls 7*a* and discs 6*b* have cavities 8*b* with walls 7*b*. These cavities 8*a*, 8*b* are of spiral shape, starting substantially tangentially to the perimeter of the discs. They may as well start angled about 9° in respect to the tangent of the rotors perimeter, e.g. for shortening the distance of the travel of the working medium. Discs 6*a* have an opening in the centre, to allow the travel of the working medium to the outlet channel 4. Discs 6*a* and 6*b* can be made of metal, preferably aluminium, and connected together to form one disc with very narrow slits. Two of such discs joint together on the shaft 5 create a rotor of the turbine. All four parts of the rotor disc are connected durably and symmetrically by means of the glue and screws in such a way, that the proper balance of the fast rotating rotor disc is preserved.

Figure 6:
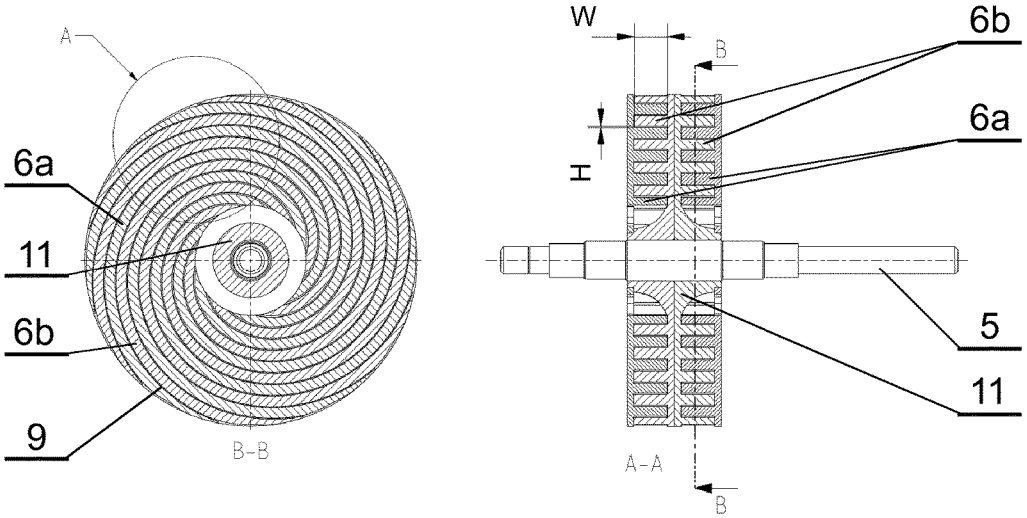
FIG. 6 shows cross sections of the rotor assembly of the first embodiment.

FIG. 6 illustrates cross-sections of the rotor assembly of the first embodiment. The disc 6*a* is inserted into disc 6*b*, so that the working cavity 9 is created between the walls 7*a* and 7*b*. The working cavity 9, according to this invention, is of generally spiral shape and of generally rectangular cross-section with the width dimension W and height dimension H, such that it has a form of a slit. By width W it is meant, here and further in the description, a dimension of the top and the bottom sides of the rectangle constituting the cross-section profile of the working cavity, said top and bottom sides being arranged substantially parallel to the axis of the rotation of the rotor 3. The height H is oriented generally parallel to the radius of the rotor.

The width dimension W is greater than the height dimension H. The height H of the slit is not greater than six times the thickness of a boundary layer of the working medium developed on the internal surface of the wider wall of the cavity 9, i.e. on the surfaces defining the width of the cavity 9. Therefore, the thickness of the core layer is not greater than the sum of the thicknesses of the boundary layers formed on the top and bottom sides of the rectangle profile constituting the cross-section. Such height of the slit is considered optimal, as the effects of viscosity are of high significance. For larger heights the effects of viscosity play smaller role and such embodiments are considered as not optimal. However, it is possible for the slit to have lower height, for example four times the thickness of the boundary layer (so that the core layer has a thickness equal to the total thickness of the boundary layers) or two times the thickness of the boundary layer (so that substantially no core layer is formed). The height H of the cavity 9 is therefore adapted to the parameters of the turbine operation under normal operation conditions, i.e. within a specific range of temperatures and pressures for which the turbine is designed to operate, and the type of the working medium for which the turbine is designed, i.e. a working medium defined for the turbine. The boundary layer thickness, δ, is the distance across a boundary layer from the wall to a point where the flow velocity has essentially reached the 'free stream' velocity, $u_0$. This distance is defined normal to the wall.

The boundary layer will have, depending on the medium used and its parameters, a thickness from about 0.2 to about 0.7 mm. Therefore, the height H of the slit 9 is preferably from about 0.4 mm to about 4 mm. More preferably, the height H of the slit 9 is from 0.5 mm to 1.5 mm.

This allows the working fluid to come into contact mainly with the top and bottom surfaces of the working cavity. The turbine uses the effects of adhesion and viscosity. This, in connection with the passing of the working fluid about from 180° to 270° of the discs circumference, assures high efficiency of the energy translation from the working medium to the shaft of the rotor. The mounting of discs 6*b* to the shaft 5 is of conical shape. This allows for directing the outflowing medium to the outlet channels 4 and favours more laminar flow of the working medium.

Figure 7:
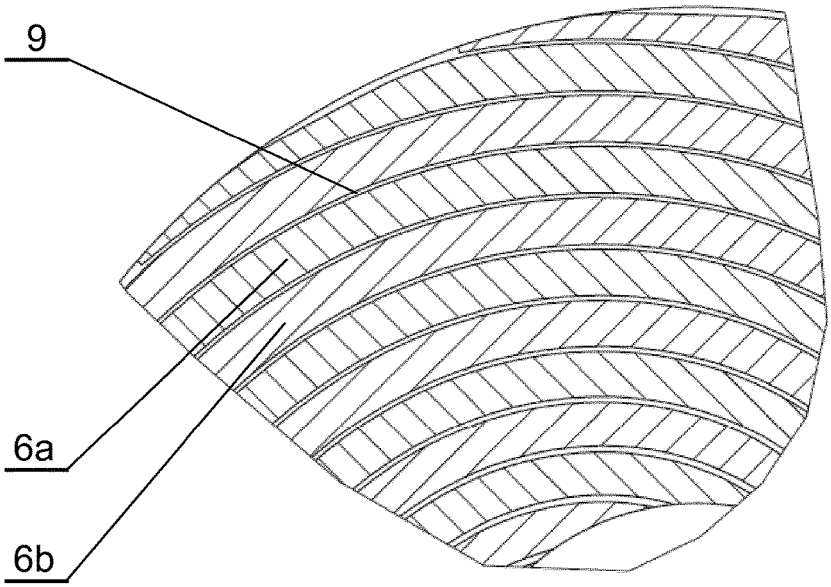
FIG. 7 shows enlarged view of a portion of the coupled discs 6*a* and 6*b* according to the first embodiment.

FIG. 7 is an enlarged view of the cross-section of the first embodiment of the invention. It shows the working cavity 9, constituted by the walls 7*a* and 7*b*.

Preferably, the profile of the working cavity 9 is of dimensions 18 mm×0.8 mm, but may as well be of height measuring from 0.5 mm to 1.5 mm, and width of greater dimension than said height to the extent matching the demands, e.g. for specific output power. The profile may also have variable dimensions throughout subsequent sections, while maintaining the width-height ratio as stated above. In different possible embodiment, the working cavity may be created using only one disc with cavities, for example with said cavities cut in the disc material using a common CNC machine. In such embodiment, the fourth wall of the cavity cross-section profile would be formed by stacking either a smooth disc without cavities or another disc with cavities on the other side.

Figure 8:
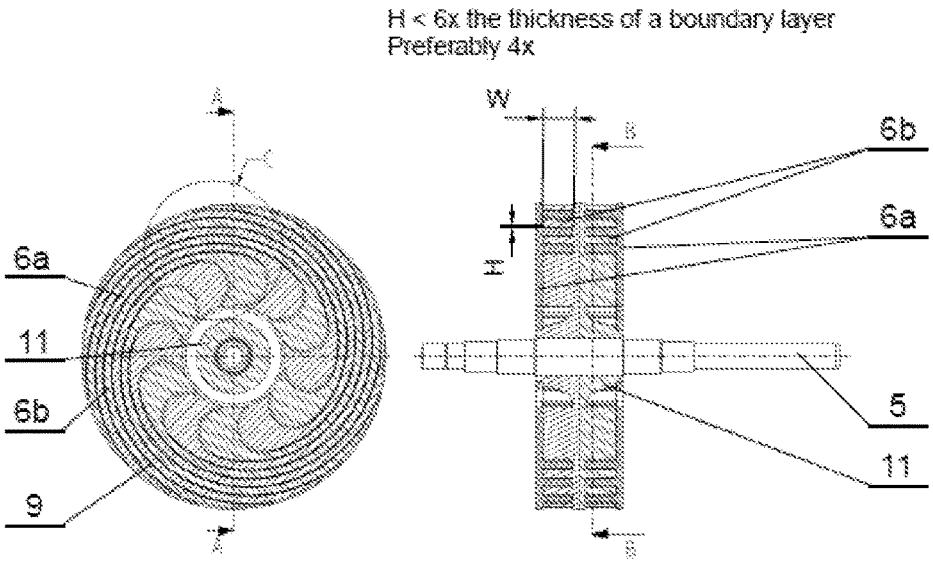
FIG. 8 shows cross sections of the rotor assembly of the second embodiment.

FIG. 8 shows another embodiment of the invention. In this embodiment, the working cavity 9 has an end portion 10 for directing the outflowing working medium opposite to the direction of the rotor 3 rotation. It can be achieved for instance by increasing the curvature of the working cavity shape in the area near the half of the disc radius, so that it forms a half of the circle, starting tangentially to the initial curvature of the working cavity 9 near the half of the disc radius and ending substantially tangentially to the opening in the disc, allowing for the exit of the working medium in a manner as stated above.

Figure 9:
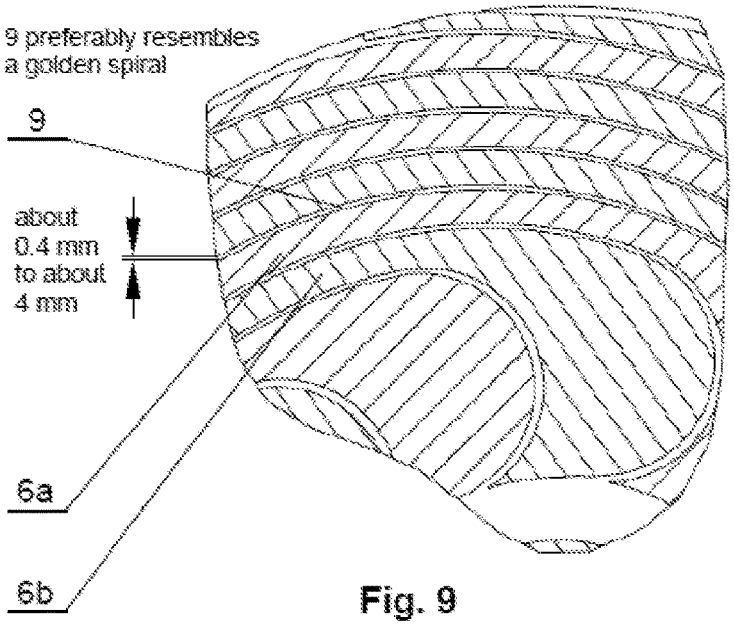
FIG. 9 shows enlarged view of a portion of the coupled discs 6*a* and 6*b* according to the second embodiment.

FIG. 9 is a closer view of the cross-section of the second embodiment, as described in the previous paragraph.

Figure 10:
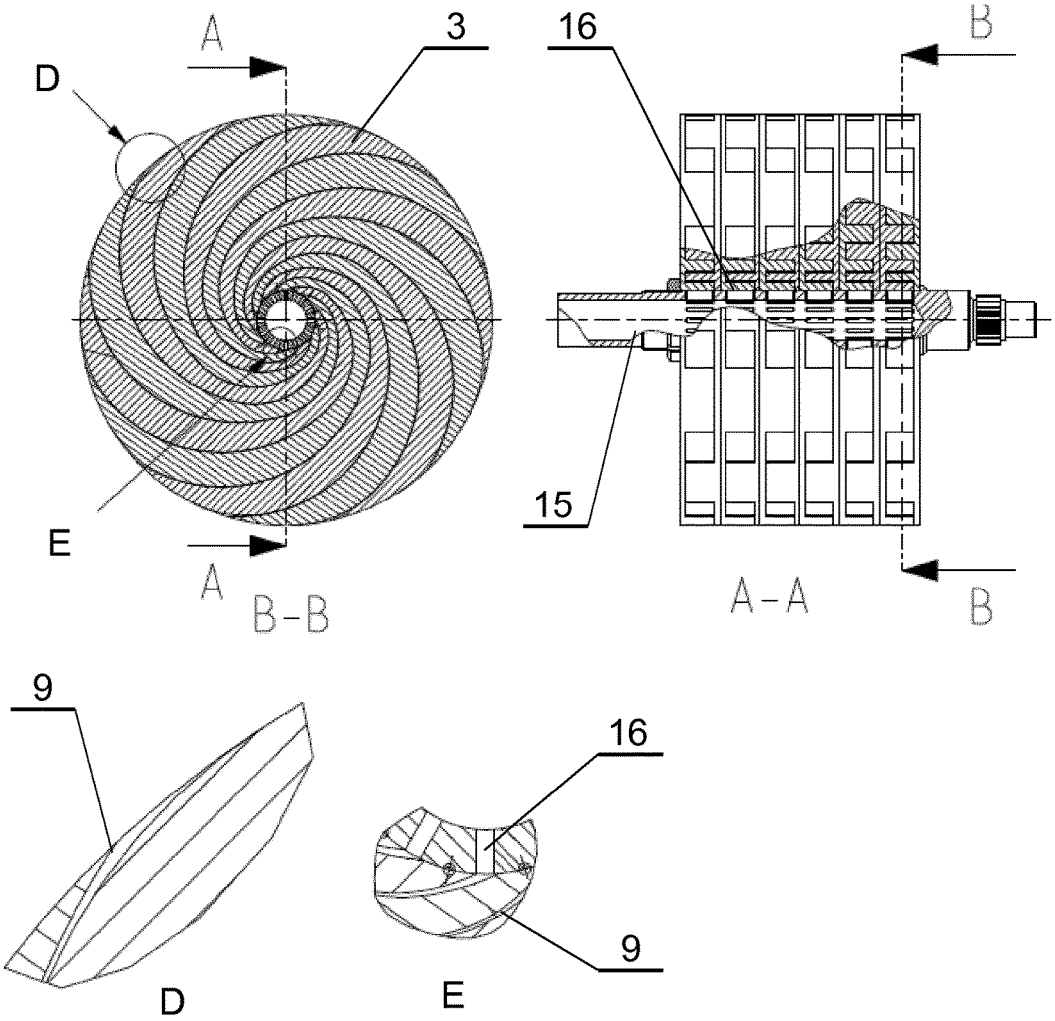
FIG. 10 shows another embodiment of the turbine.

FIG. 10 shows another embodiment of the turbine. The rotor 3 is mounted on a hollow shaft 15 comprising holes 16. The enlarged view E shows the end of working cavity 9, connected to the hole 16 so that the working medium can pass to the passage inside the hollow shaft 15. As a result, said hollow shaft 15 constitutes the outlet channel 4 for a working medium, which entered through the inlet. The enlarged view D shows the initial portion of working cavity 9. Preferably, in the initial portion, the height of working cavity 9 is about five times larger than its minimum height throughout the rotor 3. Similarly, the ending portion of the cavity working 9, as shown in the enlarged view E, widens before the connection to the hole 16, to provide expansion of the working medium. This widening, ending portion can be of up to 30% of the total length of the working cavity 9.

The stream of working medium can be directed at an angle to the tangent of rotors 3 circumference, the angle being preferably up to 30 degrees, more preferably up to 15 degrees.

The spiral shape of working cavities 9 can preferably resemble a golden spiral (e.g. Fibonacci spiral).

Figure 11:
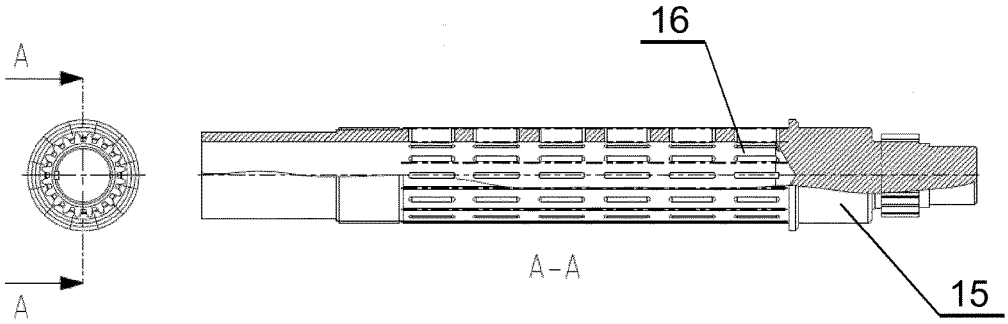
FIG. 11 shows a shaft of the rotor according to another embodiment.

FIG. 11 shows a shaft 15 of the rotor according to the embodiment, as described in previous paragraph.

The invention claimed is:

1. A radial turbine comprising:

a housing;

a rotor mounted within the housing on a shaft;

an inlet channel for supplying a defined working medium generally tangentially in respect to a circumference of the rotor;

an outlet channel located near a centre of the rotor;

the rotor comprising working cavities having a spiral shape starting tangentially to a circumference of the rotor, for conducting the defined working medium from the inlet channel to the outlet channel;

each of the working cavities having a rectangular cross-section, which has a width, oriented parallel to an axis of rotation of the rotor, and a height, oriented generally parallel to a radius of the rotor;

each of the working cavities having a wider wall with a boundary layer of the defined working medium developed on an internal surface of said wider wall;

wherein said width is greater than said height of the rectangular cross-section, and said height is not greater than six times a thickness of said boundary layer.

2. The radial turbine according to claim 1, wherein the working medium is steam.

3. The radial turbine according to claim 1, wherein the rotor is formed by at least two discs inserted within said housing on said shaft oppositely to each other.

4. The radial turbine as claimed in claim 3, wherein the working cavities in a first disc of the at least two discs constitute spaces allowing insertion therein of a second disc of the at least two discs, the second disc being arranged opposite to the first disc, such that when the first disc is assembled with the second disc, their working cavities form the working cavities having a spiral shape, through which the working medium passes on its way from the inlet channel to the outlet channel, such that the working medium travels around the shaft at least 180 degrees before it reaches the outlet channel.

5. The radial turbine according to claim 1, wherein each of the working cavities has an end portion for directing the outflowing working medium opposite to a direction of rotation of the rotor.

6. The radial turbine according to claim 1, wherein said height is from 0.4 mm to 4 mm.

7. The radial turbine according to claim 1, wherein said width is at least 10 times larger than said height.

8. The radial turbine according to claim 1, wherein the rotor has a conical portion for mounting on the shaft, for directing the outflowing working medium to the outlet channel.

9. The radial turbine according to claim 1, wherein the height of each of the working cavities is equal to four times the thickness of said boundary layer.

10. The radial turbine according to claim 1, wherein the height of each of the working cavities is equal to two times the thickness of said boundary layer.

11. The radial turbine according to claim 1, wherein the spiral shape of each of the working cavities corresponds to a shape of a golden spiral.

12. The radial turbine according to claim 1, wherein the shaft is a hollow shaft comprising holes, wherein the holes are connected to ends of each of the working cavities, so that the hollow shaft constitutes the outlet channel.

* * * * *